US006142118A

United States Patent [19]

Motose

[11] Patent Number: 6,142,118

[45] **Date of Patent: *Nov. 7, 2000**

[54] ENGINE IDLE CONTROL

[75] Inventor: Hitoshi Motose, Shiuzoka-ken, Japan

[73] Assignee: Sanshin Kogyo Kabushiki Kaisha, Japan

[ * ] Notice: This patent is subject to a terminal disclaimer.

[21] Appl. No.: 08/531,103

[22] Filed: Sep. 20, 1995

[30] Foreign Application Priority Data

May 10, 1994 [JP] Japan ..... 6-119723

[51] Int. Cl.[7] ..... F02M 35/10; F02M 3/12

[52] U.S. Cl. ..... 123/339.1; 123/73 A; 123/339.13

[58] Field of Search ..... 123/339.1, 339.23, 123/337, 339.13, 73 A; 251/305

[56] References Cited

U.S. PATENT DOCUMENTS

| | | | |
|---|---|---|---|
| 3,620,195 | 11/1971 | Lamm | 123/337 |
| 4,158,352 | 6/1979 | Blatter | 123/337 |
| 4,438,049 | 3/1984 | Ammons | 123/339.1 |
| 4,438,745 | 3/1984 | Watanabe | 123/337 |
| 4,462,358 | 7/1984 | Ishida et al. | 123/337 |
| 4,480,367 | 11/1984 | Johnson et al. | 123/337 |
| 4,759,326 | 7/1988 | Uthoff, Jr. et al. | 123/337 |
| 4,966,122 | 10/1990 | Frinzel | 123/339.1 |
| 5,282,448 | 2/1994 | Reinke et al. | 123/337 |
| 5,522,362 | 6/1996 | Motose | 123/339.13 |

*Primary Examiner*—Henry C. Yuen
*Assistant Examiner*—Hieu T. Vo
*Attorney, Agent, or Firm*—Knobbe, Martens, Olson & Bear, LLP

[57] ABSTRACT

An engine idle and speed control arrangement incorporating a butterfly-type throttle valve. The throttle valve is disposed so that it is at a relatively small angle to a plane containing the throttle valve axis and extending perpendicular to the direction of air flow through the induction passage. The peripheral edge of the throttle valve is configured so as to avoid binding. Bypass idle air flow is provided around the throttle valve as to provide substantially the entire idle air speed requirements of the engine. This arrangement permits better idle control since the idle air-flow changes will be more uniform in response to given angular changes in the position of the throttle valve.

7 Claims, 8 Drawing Sheets

ENGINE IDLE CONTROL

BACKGROUND OF THE INVENTION

This invention relates to an engine speed control and more particularly to an improved control for the engine idle speed and also to a throttle control for improving the control of the air flow to an engine.

As is well known, the speed of an internal combustion engine is generally controlled by controlling the amount of air that is supplied to the engine during its running. Normally, a throttle valve is provided for controlling this air flow in spark-ignited engines. The type of throttle valve most conventionally employed is the so-called "butterfly" type of throttle valve. With this type of throttle valve, the generally circular plate-type throttle valve is affixed to a throttle valve shaft that extends across the induction passage and controls the degree of air flow by its rotary or angular position.

The amount of fuel supplied to the engine is varied generally in response to the amount of air supplied. The amount of air flowing to the engine may be determined in a number of ways. For example, throttle position sensors are frequently employed so as to provide an indication of the throttle valve position and, accordingly, the amount of air flow to the engine. Alternatively, actual air flow sensors may be employed.

The amount of fuel supplied is then varied in response to the air flow so as to provide the desired fuel-air ratio for a given running condition. This type of control is particularly employed in conjunction with fuel injection systems wherein the amount of fuel injected may be controlled by methods other than the pressure difference across the fuel discharge circuits, as is the case with carbureted engines.

One particularly sensitive running condition for engines is the idle operation. Normally, the idle speed is controlled by controlling the idle position of the throttle valve. In conventional engines the throttle valve is rotatably positioned in the induction passage so that it lies at an angle of approximately 14 degrees (14°) to a plane passing through the rotational axis of the throttle valve and extending generally perpendicularly to the flow path through the portion of the induction passage in which the throttle valve is positioned. There are a number of disadvantages with this type of arrangement.

The first of these disadvantages is that at this degree of throttle valve position, incremental changes in the angular position of the throttle valve do not result in linear changes in the air flow. This condition may be best understood by reference to FIGS. 1 and 2. FIG. 1 shows the air flow through the induction passage in response to the degree of opening of the throttle valve from its fully closed position. As may be seen, during the idle and low-speed range, indicated by the area bracketed at A, for a given degree of throttle valve opening in this range, there is a significantly different degree of air flow.

The reason for this may be understood by reference to FIG. 2 in which the solid-line view is an expanded view showing the effective induction passage flow area in response to a given throttle valve position. The point indicated at I is the normal idle position of the throttle valve. As may be seen, the curve of the throttle valve opening has a slope θ2 at this point, which is relatively great. As a result, a small degree of change in throttle valve opening provides a large change in effective flow area. Thus if fuel amount is controlled by throttle valve position, a non-linear fuel/throttle valve position curve must be employed. Furthermore this condition continues to progress as the throttle valve is opened to an off-idle condition, indicated at B.

If, rather than controlling the degree of idle air flow by positioning the throttle valve in such an open condition as the 14 degree position as in the prior art construction, it is possible to maintain the throttle valve in a substantially closed position and provide the air flow through an independent source, then a curve as shown in phantom lines in FIG. 2 can result. With such an arrangement, the change in slope of the curve as the throttle valve is opened from its fully closed position is lower, and the air flow variations will be more uniform and linear. Thus the amount of fuel supplied in response to throttle valve position can be varied in a more linear manner. This permits better idle speed control as well as better fuel economy and emission control.

It is, therefore, a principal object of this invention to provide an improved idle control arrangement for an internal combustion engine.

It is a further object of this invention to provide an improved flow controlling throttle valve arrangement for an engine wherein the throttle valve is maintained in a closed position at idle and the air flow is provided independently of the position of the throttle valve for idle operation so as to maintain a more uniform off-idle operation and better idle speed control.

It is a further object of this invention to provide an improved arrangement wherein the idle speed and fuel supply amount can be accurately controlled by minute movements of the throttle valve from its fully closed position if additional air flow is required.

In addition to the defects noted, it has also been found that air flow meters are capable of sensing variations in air flow better if the initial opening of the throttle valve is smaller. That is, the air flow through the intake passage can be more easily measured, particularly with minute variations, when the degree of throttle valve opening is smaller.

Although it would appear obvious from the foregoing description to provide an arrangement wherein the throttle valve is fully closed and extends at a perpendicular relationship to the intake passage at idle, this is not necessarily the optimum condition, as has been found. The reason for this is that the shape of the peripheral edge of the throttle valve must be accurately controlled so as to avoid a biting or digging-in action when opening from this position.

It is, therefore, a still further object of this invention to provide an improved throttle control valve arrangement for an engine wherein the throttle valve is positioned at a relatively small angle to the perpendicular in the idle condition and wherein the throttle valve substantially closes the air flow through the intake passage in this condition.

SUMMARY OF THE INVENTION

This invention is adapted to be embodied in a throttle valve arrangement for an internal combustion engine induction system having an inlet passage and a butterfly-type throttle valve supported for rotation about a throttle valve axis in a portion of the induction passage for controlling the flow therethrough. The throttle valve has a peripheral configuration that is substantially complementary to the shape of said induction passage portion when said throttle valve is in a closed position at an angle in the range of about two to twelve degrees (2°–12°) and preferably in the range of five to eleven degrees (5°–11°) to a plane containing the throttle valve axis and extending generally perpendicularly to the flow direction through the induction passage portion. The peripheral portion of the throttle valve is substantially complementary to the shape of the induction passage portion when in its closed position so as to provide substantially no air flow gap therepast. Means provide a bypass air flow past the throttle valve for at least engine idle air flow when the throttle valve is in the closed position.

DETAILED DESCRIPTION OF THE PREFERRED EMBODIMENTS OF THE INVENTION

Figure 1:
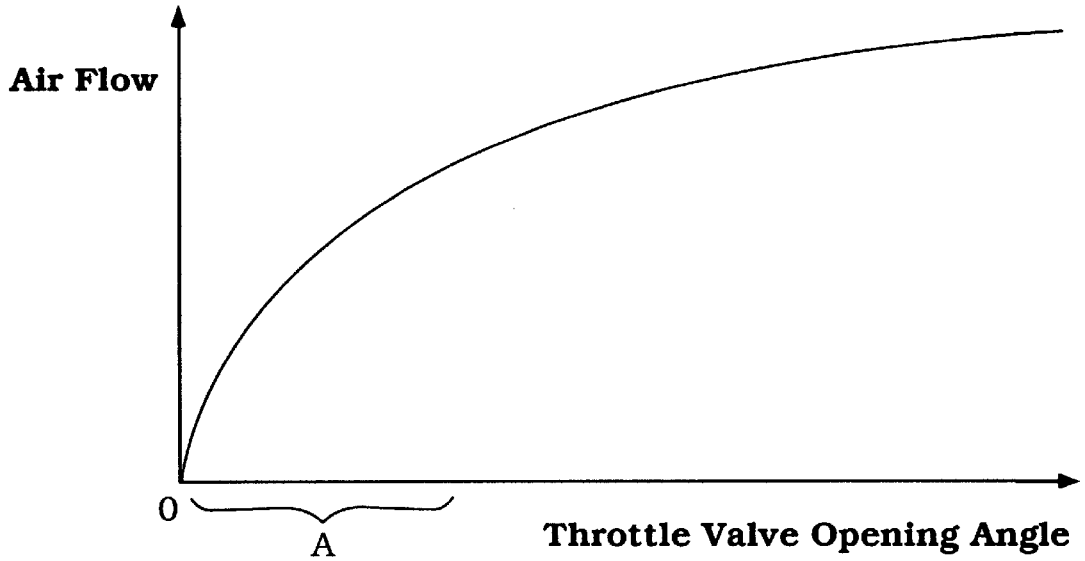
FIG. 1 is a graphical view showing the air flow through an intake passage in relation to throttle valve opening in accordance with a prior art type of construction.
Figure 2:
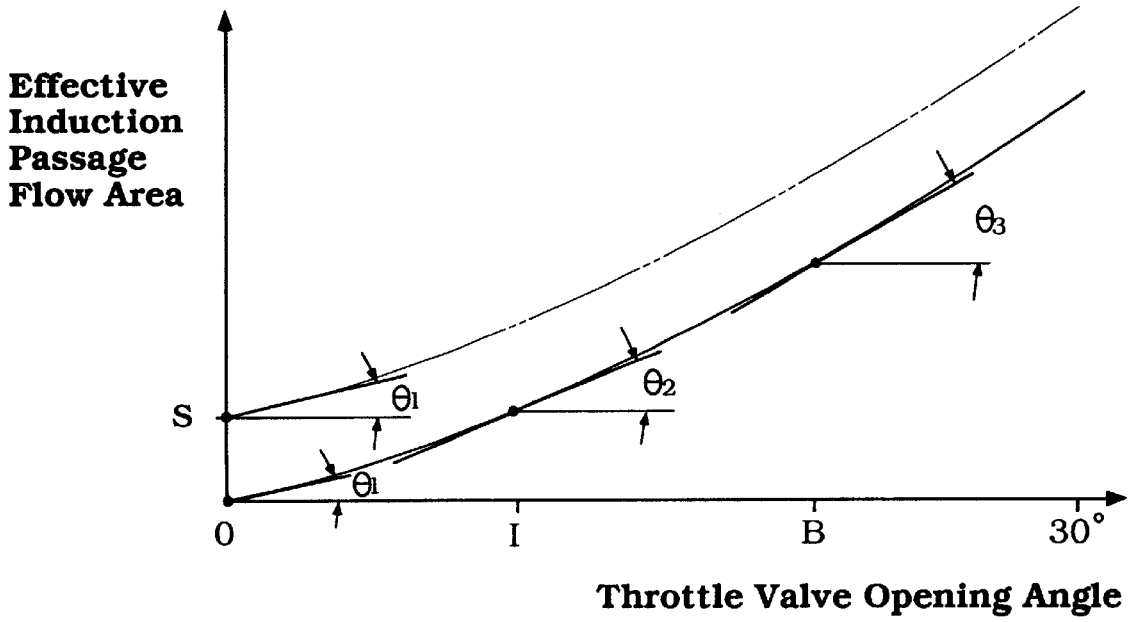
FIG. 2 shows in graphical view in solid lines the effective flow area of the induction passage in response to the angular opening of the throttle valve, while the phantom-line view shows the corresponding condition in accordance with an embodiment of the invention.
Figure 3:
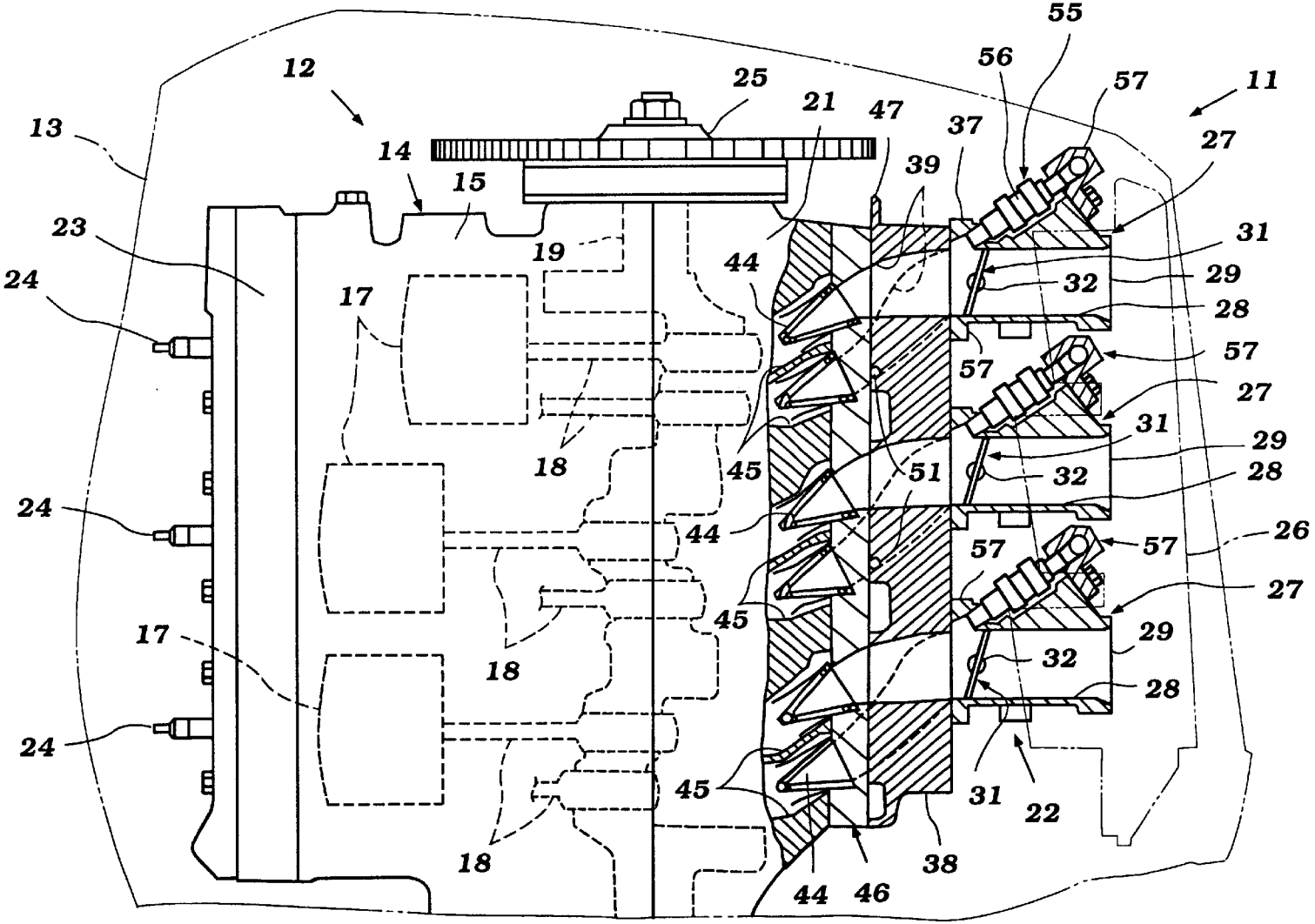
FIG. 3 is a side elevational view of the power head of an outboard motor constructed in accordance with an embodiment of the invention, with the induction system shown in cross section taken along a line 3—3 of FIG. 4 and with the protective cowling shown in phantom.
Figure 4:
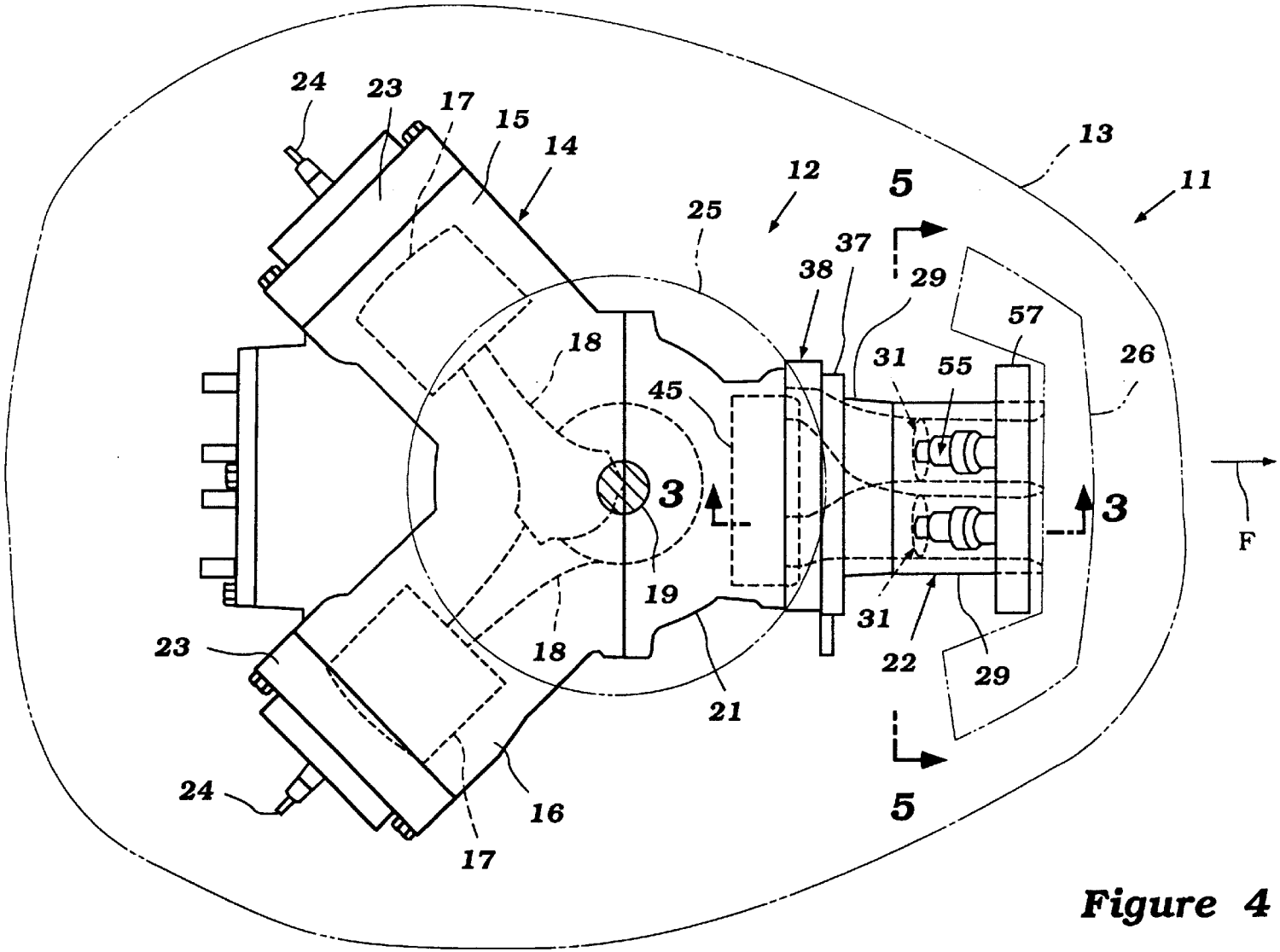
FIG. 4 is a top plan view of the power head, again showing the protective cowling in phantom.

Referring now in detail to the drawings, and initially to the embodiment of FIGS. 3–7 and initially primarily to FIGS. 3 and 4, the power head of an outboard motor is shown partially and is identified generally by the reference numeral 11. The invention is described in conjunction with an outboard motor because this is a typical environment in which the invention may be practiced. It will be readily apparent, however, to those skilled in the art that the invention is capable of use in a wide variety of applications for internal combustion engines.

The invention, in some respects, has particular utility in conjunction with two-cycle crankcase compression engines, and since such engines are frequently employed in conjunction with outboard motors, the outboard motor 11 is a typical environment in which the invention may be utilized.

The outboard motor 11 includes an internal combustion engine, indicated generally by the reference numeral 12, and a surrounding protective cowling, shown in phantom and indicated by the reference numeral 13.

In the embodiment illustrated, the engine 12 is of the V-6 type and, accordingly, is provided with a cylinder block 14 having angularly disposed cylinder banks 15 and 16. Each cylinder bank is formed with three cylinder bores, each of which receives a respective piston 17. The pistons 17 are connected by means of piston pins (not shown) to the upper or small ends of connecting rods 18. The connecting rods 18 have their lower or big ends journalled on a crankshaft 19 in a well-known manner. As is typical with V-type engine practice, the cylinders of the cylinder bank 15 are offset from those of the cylinder bank 16 so that the connecting rods 18 of adjacent cylinders of each bank may be journalled on a common throw of the crankshaft 19.

As is typical in outboard motor practice, the engine 12 is mounted in the power head in such a manner so that the crankshaft 19 rotates about a vertically extending axis. This is to facilitate connection of the lower end of the crankshaft 19 to a drive shaft (not shown) that depends into a drive shaft housing and lower unit for driving a propulsion device such as a propeller or the like for propelling an associated watercraft.

The crankshaft 19 is rotatably journalled in a crankcase assembly formed by a skirt of the cylinder block 14 and a crankcase member 21 that is affixed thereto in a known manner. As is typical with two-cycle crankcase compression engines, the crankcase chamber associated with each of the pistons 17 is sealed from the others so that the intake charge can be drawn into it through an induction system, indicated generally by the reference numeral 22, and which will be described later by reference to the remaining figures of this embodiment. This charge is then compressed in the crankcase chambers and transferred to the combustion chamber formed above the pistons 17 by the cylinder bores and by cylinder heads 23 that are affixed to the cylinder blocks 15 and 16 in a known manner.

The charge is then fired by spark plugs 24 that are fired by an ignition system which includes a flywheel magneto 25 affixed to the upper end of the crankshaft 19. The burnt charge is then discharged to the atmosphere through an exhaust system in a well-known manner.

The construction of the engine 12 as thus far described may be considered to be conventional, and for that reason, further details of the basic engine construction are not believed to be necessary to enable those skilled in the art to practice the invention. As should be apparent from the foregoing description, the invention deals primarily with the induction system 22, and specifically the throttle and idle control arrangements therefor.

The induction system 22 includes an air inlet device of any known type, indicated by the reference numeral 26. Since it, per se, forms no part of the invention, it is shown in phantom, and further description of it is not believed to be necessary. However, the inlet device 26 draws atmospheric air from within the protective cowling 13 in a manner as well known in this art. The cowling 13 is provided with an appropriate atmospheric air inlet for this purpose.

Each of a plurality of throttle bodies, each indicated by the reference numeral 27, has a pair of parallel intake passages 28 that extend from inlet openings 29 formed in the interior of the air inlet device and receive this atmospheric air. In the illustrated embodiment, since the engine 12 is of the V-6 type, there are provided three throttle bodies, each having a pair of side-by-side intake passages 28.

A butterfly-type throttle valve assembly 31 constructed in accordance with the invention is supported in each of these intake passages 28 on a respective throttle valve shaft 32. That is, each throttle body has one throttle valve shaft 32 on which two butterfly-type throttle valves 31 are affixed.

Figure 5:
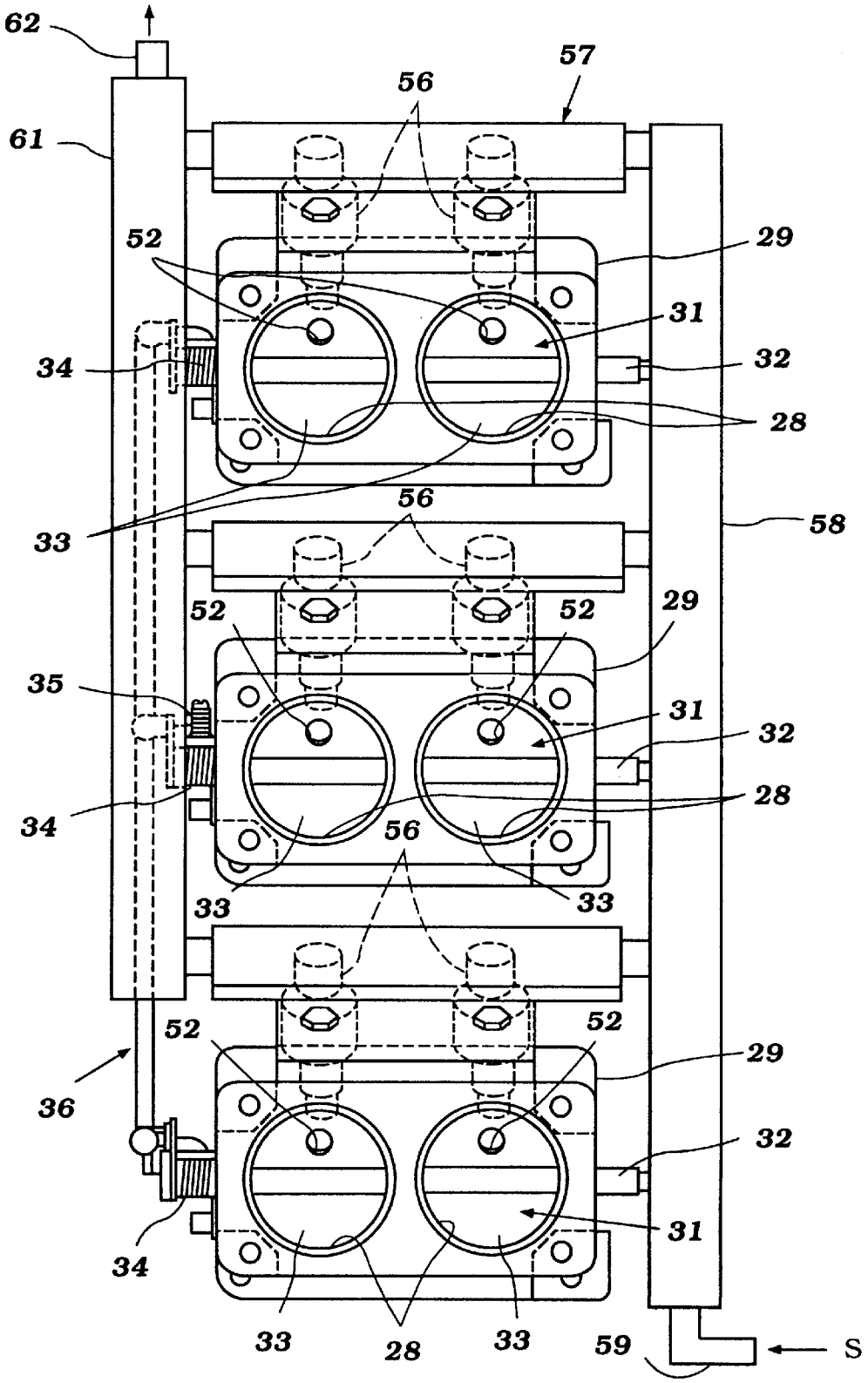
FIG. 5 is a view taken in the direction of the line 5—5 in FIG. 4 and shows the throttle valve bodies of the induction system and associated components when at idle.
Figure 7:
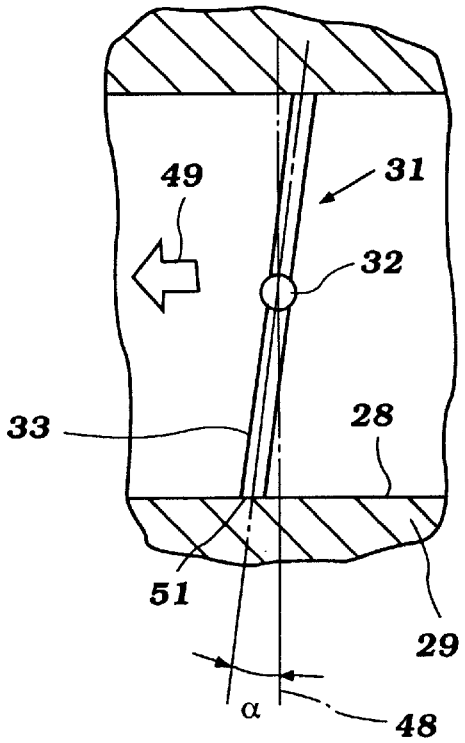
FIG. 7 is an enlarged cross-sectional view taken along the same plane as FIG. 3 and shows the geometric relationship of the throttle valve in its closed, idle position.

As may be best seen in FIGS. 5 and 7, the butterfly-type throttle valves 31 include circular valve plates 33, each of which is positioned in a respective one of the intake passages 28 and which has an effective diameter that is substantially equal to the respective intake passage 28.

Torsional springs 34 encircle one end of the throttle valve shafts 32 and urge the throttle valves 33 and throttle valve shafts 32 toward a closed positioned. An adjusting screw 35 cooperates with one of the throttle valve shafts 32 so as to control this extreme position.

A linkage arrangement 36 interconnects the throttle valve shafts 32 so that they are simultaneously operated. This linkage system is connected to a remote actuator (not shown) so that the throttle valve position can be controlled by an operator at the remote location.

Each throttle body 27 is provided with a flanged base portion 37 that is detachably connected to a common intake manifold 38. The intake manifold 38 is formed with pairs of side-by-side intake passages 39 which have generally circular intake ends 41 that are complimentary in shape to the throttle body intake passages 28 and then merge into generally rectangular outlet portions. These outlet portions are indicated by the reference numerals 42 and 43, and as may be seen in FIG. 3 the outlet portions 42 are disposed vertically above the outlet portions 43. The spacing between the outlet portions 42 and 43 in a vertical direction is the same as the offset of the cylinder banks 15 and 16 from each other. As has been noted, the cylinder banks are offset so that the connecting rods 18 of each cylinder bank may be positioned in side-by-side relationship on the same throws of the crankshaft 19.

Reed-type check valves 44 are provided in intake ports 45 formed in the crankcase member 21 and which cooperate with the respective crankcase chambers, previously referred to. The reed-type check valves 44 may be formed with a common valve plate 46 that is sandwiched between a flange 47 of the intake manifold 38 and the mating face of the crankcase chamber 21. The various sealing surfaces described may be either machined and/or gaskets may be interposed therebetween for sealing purposes.

As may be best seen in FIG. 7, the construction of the butterfly-type throttle valves 31 is such that in their fully closed position, as shown in FIGS. 5 and 7, the throttle plates 33 are disposed at an angle $\alpha$ to a plane 48, which plane extends generally perpendicularly to the flow direction through the intake passage 28, as indicated by the arrow 49. This angle $\alpha$ is chosen so as to be in the range of two to twelve degrees (2°–12°) and more preferably in the range of five to eleven degrees (5°–11°), and optimally ten degrees (10°), for the reasons which have already been described but which will be summarized again below. This angle $\alpha$ is substantially less than the normal fourteen degree (14°) angle at which the throttle plates 33 are positioned in the idle condition. This is for of two reasons. First, as will be described, a flow path is provided around the throttle valves 33 for idle air flow so the throttle valves 33 can be in a more fully closed position than with the prior art-type of construction. In addition, this position is chosen rather than the full 90-degree position so that the peripheral edge 51 of the throttle plates 33 can be beveled so as to permit good sealing without obstruction and the likelihood of binding when the throttle plates 33 are opened.

Hence, in this closed position the peripheral edge 51 of the throttle valve plate 33 is in substantial coincidental relationship to the surrounding portion of the induction passage 28 so that there is no air flow gap therebetween. However, by beveling of the edges 51, the throttle valve can be effectively opened without binding.

Figure 6:
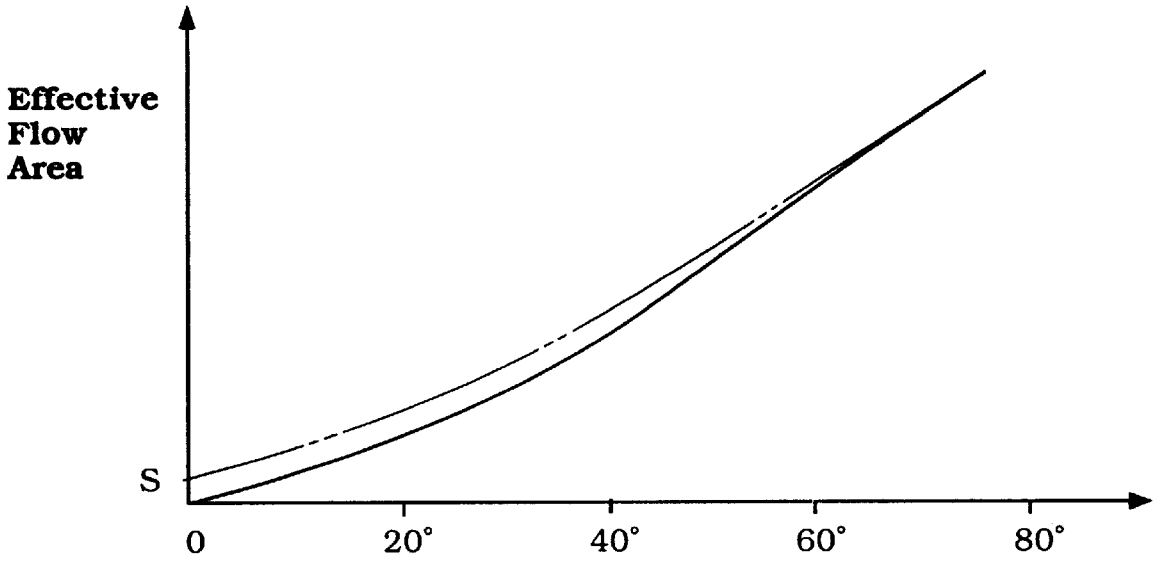
FIG. 6 is a graphical view showing the effective flow area provided by this embodiment in response to throttle angle position in phantom line and in relation to a conventional type of throttle valve having the same initial position as shown in solid lines.

The effective flow area is indicated by the solid-line view of FIG. 6. In accordance with this embodiment of the invention, an individual flow opening 52 is provided in each of the throttle valve plates 33 at a point offset to one side of the throttle plate 33 from the axis defined by the throttle valve shaft 32. This flow area is indicated by the point S in the phantom-line view of FIG. 6. This opening is chosen so as to provide an area that is equal to or somewhat less than the anticipated minimum idle air flow to maintain engine stability. Fine adjustments may be made by minor opening of the throttle valve plates 33.

As seen in FIG. 6, the effect of the individual openings 52 is reduced as the throttle valve plate 33 is opened because of the angular position of the throttle plate 33. Hence, by the time the throttle valve 33 is opened in the range of 65 to 80 degrees, there will be substantially no flow through the openings 52, since they will be obstructed by the angular position of the throttle plates 33. In other words the effective size of the opening decreases as the throttle valve 33 opens. This further assists in making the throttle valve 33 more linear in operation.

Figure 8:
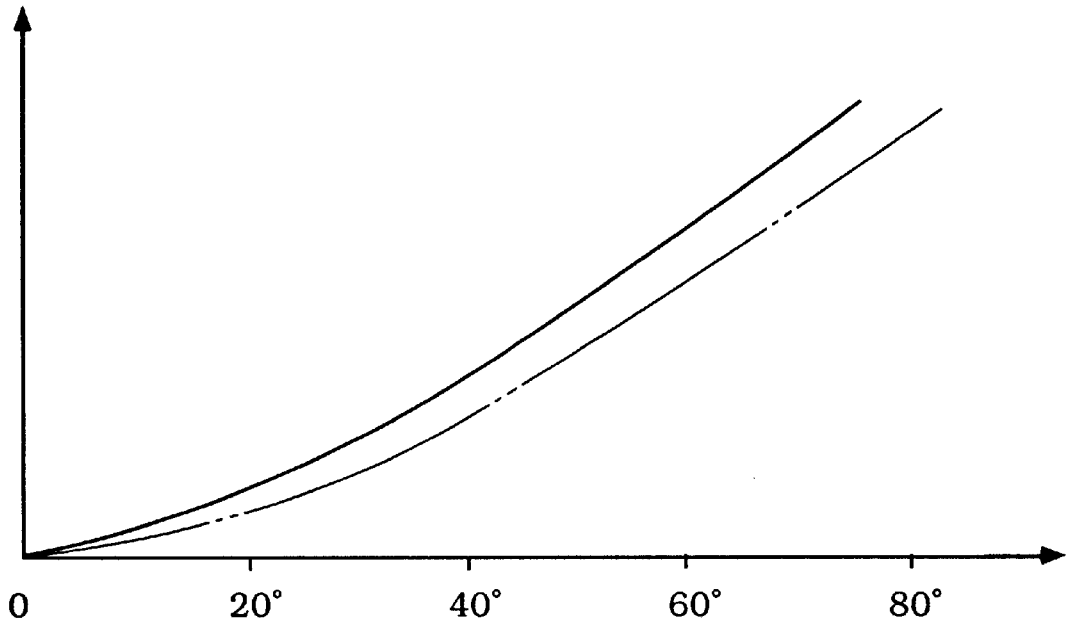
FIG. 8 is a graphical view showing the effective flow area in response to the degree of throttle valve opening in connection with a system having the throttle valve initially closed at a 14-degree position, as shown in solid lines, and initially closed in accordance with the invention, as shown in phantom lines.
Figure 9:
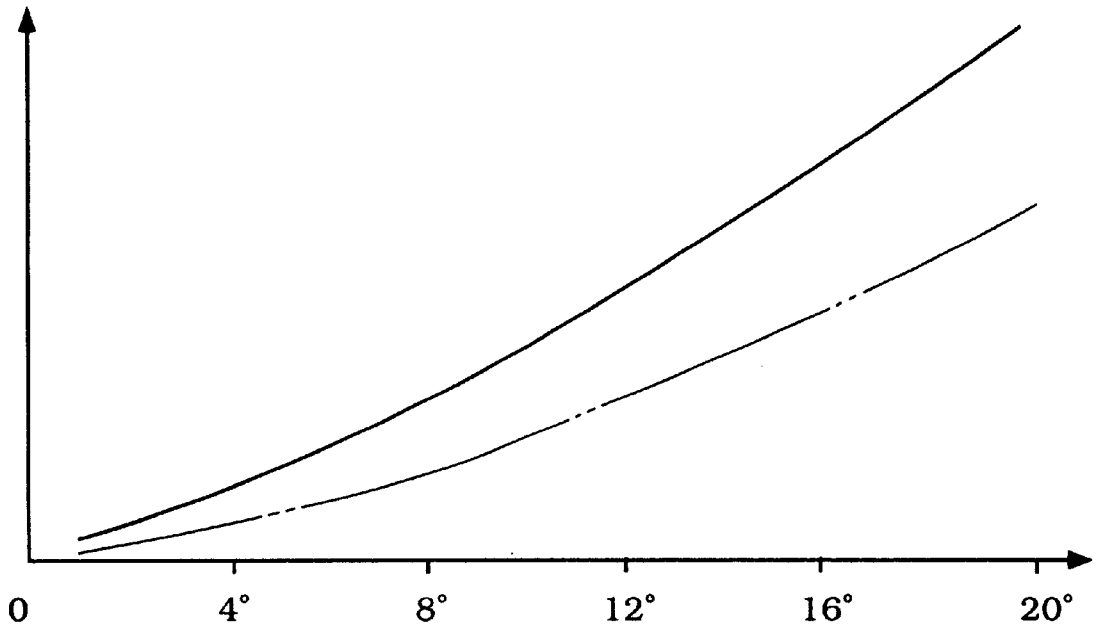
FIG. 9 is an enlarged graphical view showing the same data of FIG. 8, but only for the first twenty degrees of throttle valve opening.

As may be seen in FIG. 6, this arrangement provides a much more uniform variation in flow area in response to throttle valve opening angle, and accordingly, much better throttle response is provided. FIGS. 8 and 9 also show how the throttle valve embodying the invention (dot dash view) is more linear than the prior art type of valve (solid line view).

Furthermore, the arrangement is such that it is easier to measure the actual air flow through the induction system by the angular position of the throttle valve. Thus, regardless of whether air flow is measured by throttle angle position or actual air flow, more accurate air flow determinations are possible. Fuel control can also be more accurate therefore and the desired air-fuel ratio can be easily maintained to improve running efficiency, exhaust emission control, and optimum fuel economy.

In addition to the air which flows to the engine 12 through the air path already described, a fuel charge is also delivered into the induction system 22. This is provided by a plurality of pairs of fuel injectors 55, each of which includes a respective electronically operated fuel injector 58 that is fitted into one of a pair of bores formed in the throttle bodies 27 and which intersect the induction passages 28 downstream of the throttle valves 31 in all positions of the throttle valves. The fuel injectors 56 of each of the pairs 55 are provided with fuel through short fuel rails 57 which extend transversely across the throttle bodies 29 on their upper sides. The fuel rails 57, in turn, receive fuel from a fuel inlet manifold 58 (FIG. 5) which, in turn, receives fuel from a fuel source, indicated by the arrow S, through an inlet fitting 59.

A return manifold 61 extends across the opposite sides of the fuel rails 57 and either contains a pressure relief valve for setting the pressure at which fuel is delivered to the injector 56 or communicate with a remotely positioned pressure control valve through a conduit 62. The pressure is maintained by dumping fuel back into the fuel system somewhere on the upstream side of the delivery manifold 58.

This embodiment operates by maintaining the throttle valve assemblies 35 in their fully closed position at idle, with the size of the air flow openings 52 being such that adequate air for idle engine running is possible. As has been previously noted, in this condition the angle $\alpha$ of the throttle valve plates 33 is much smaller than the conventional arrangement and in the range of 2° to 12° and preferably in the range of 5° to 11°, and optimally 10°. As seen in FIG. 6, this provides an air flow area S, which is adequate for idle operation. However, if adjustments need to be made for idle air flow, then the throttle valve 35 may be moved through a small angle so as to provide the desired air flow.

Because of the fact that the throttle valve curve is relatively uniform in this portion of the engine running, as seen in FIG. 6, small angular changes in position of the throttle valve 33 will produce relatively small changes in air flow, and hence, the slope of the curve can be maintained more uniform and the idle control may be achieved much more efficiently. Also, since the throttle valve plate 33 is closed to a greater extent than the previously described embodiments, this result is also well achieved.

As the throttle valve 33 is progressively opened, the effective size of the holes 52 will be reduced. Thus, even though the slope of the throttle valve curve becomes more abrupt, the change in flow area tends to offset this, and the total throttle response is much more linear.

Figure 10:
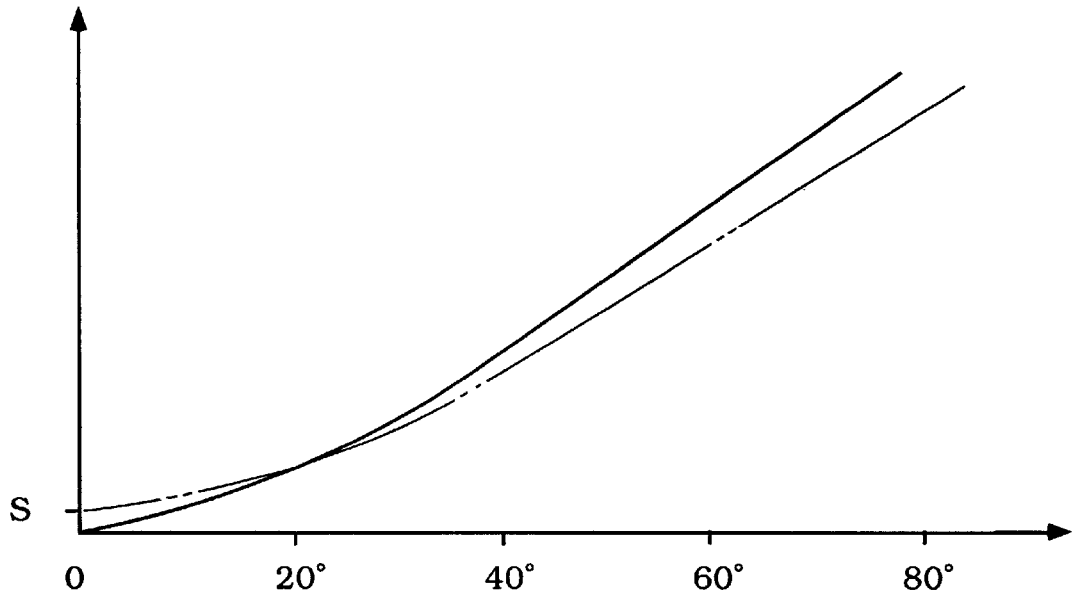
FIG. 10 is a graphical view showing the effective flow area of the invention embodying the bypass air flow passage in the phantom-line view relative to the non-air flow condition, as shown by the solid-lines .
Figure 11:
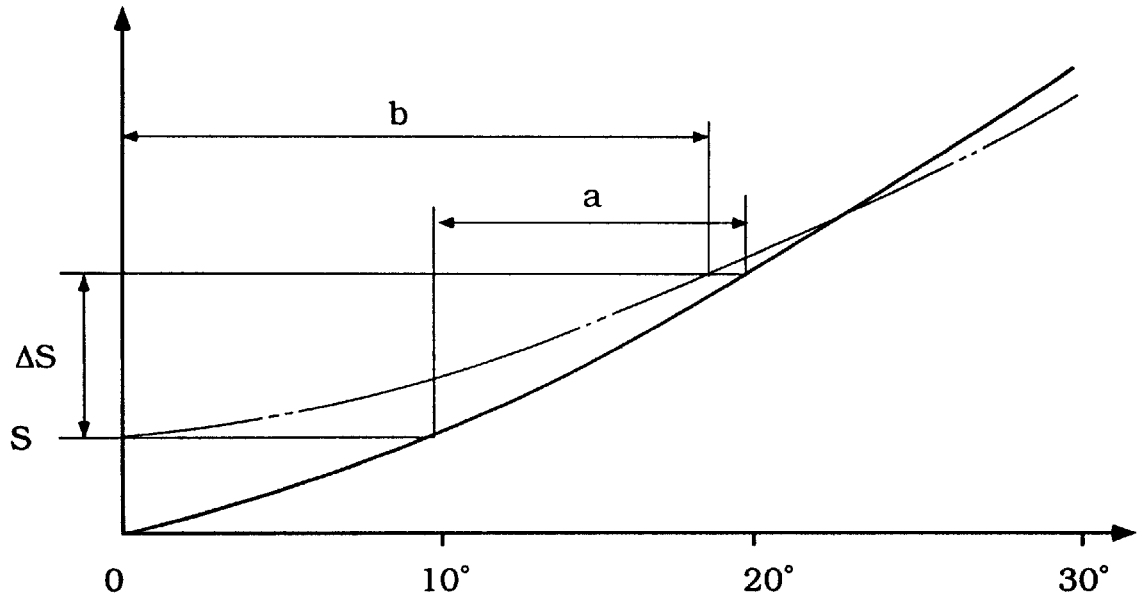
FIG. 11 is an enlarged view of the zero to thirty degree throttle opening positions of FIG. 11 and shows how the invention provides a more uniform rate of air flow in response to change in throttle valve position in accordance with the invention.

As may be seen in FIG. 10, the phantom-line curve shows the actual flow area for throttle opening, with the opening in the throttle valve in this embodiment. Hence, for a given degree of throttle opening, there will be a smaller change in the amount of air flow or effective flow area. FIG. 11 depicts this, wherein a change in flow area AS is compared between this embodiment wherein this change in flow area takes a degree of throttle opening of b which is much greater than that of a conventional throttle valve which is more fully opened at idle, as seen at a. Hence, the sensitivity is substantially reduced, and engine idle control can be much more easily obtained and will be much more uniform.

Figure 12:
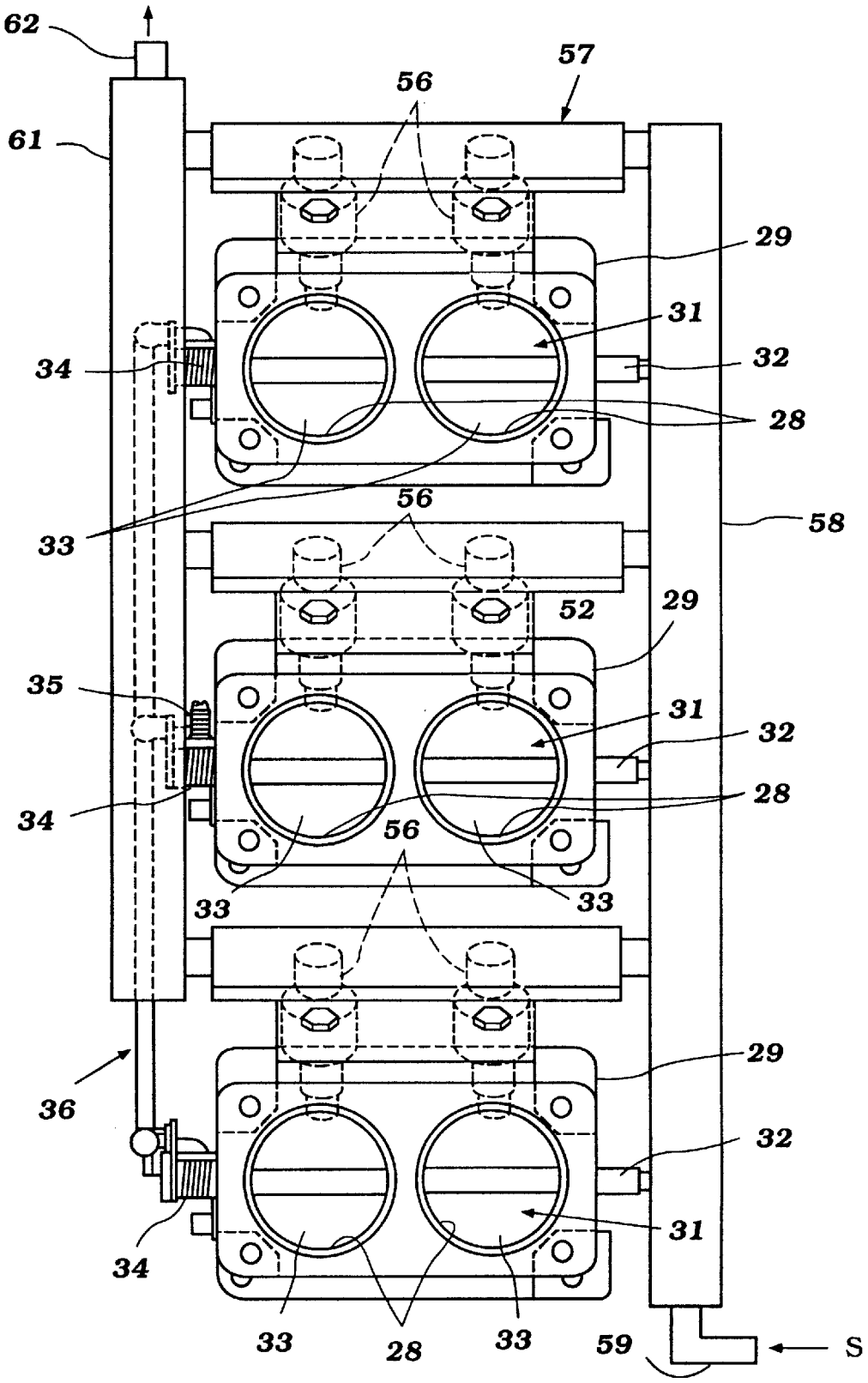
FIG. 12 is a cross-sectional view, in part similar to FIG. 5, and shows another embodiment of the invention.

In the embodiment as thus far described, the idle air flow has been provided by primarily sizing the holes 52. However, rather than having the idle air flow being provided by an opening in the throttle plates 33, a bypass throttle arrangement may be embodied, and FIG. 12 shows such an embodiment. In this embodiment it will be seen that the throttle plates 33 have no openings whatsoever in them. At idle, these throttle plates are still positioned so that they lie in a range of 2° to 12° from the plane perpendicular to the air flow, as with the previously described embodiment. Air for idle operation is provided by a bypass passages that are formed in the throttle bodies or in the intake manifold. Such an arrangement may be as shown in my copending application entitled "Idle Control Arrangement For Engine", Ser. No. 08/438,424, filed May 10, 1995, and assigned to the assignee hereof. That disclosure is incorporated herein by reference.

Various other bypass arrangements may be provided for bypassing the throttle valves in their idle position. Since this is the only difference from the previously described embodiment, components which are the same or substantially the same have been identified by the same reference numerals and will not be described again.

Thus, this embodiment has substantially the same advantages of the previously described embodiment, and further description of its operation is not believed to be necessary to enable those skilled in the art to practice the invention. However, it should be noted that this embodiment does not partake of those advantages of the previously described embodiment in which the amount of air flow will be maintained more uniform due to the progressively decreasing effect of the hole in the throttle valve. That is, in this embodiment there will always be a flow through the bypass passageway, although it will be relatively insignificant in relation to the total air flow as the engine speed increases. Again, however, the variation in air flow with respect to throttle valve opening will be much more uniform under low-speed, low-load conditions due to the more fully closed position of the throttle plates 33 at idle than with the prior art types of constructions.

Of course, the foregoing description is that of preferred embodiments of the invention, and various changes and modifications may be made without departing from the spirit and scope of the invention, as defined by the appended claims.

What is claimed is:

1. A reciprocating internal combustion engine having a combustion chamber defined by a cylinder bore and a piston reciprocating therein, an induction system for delivering at least an air charge to said combustion chamber, said induction system having an induction passage terminating in an outlet opening the flow through which is not directly controlled said piston and a butterfly-type throttle valve supported for rotation about a throttle valve axis in said induction passage for controlling the flow therethrough, said throttle valve having a peripheral configuration which is substantially complementary to the shape of said induction passage when said throttle valve is in a closed position at an angle in the range of about two degrees to twelve degrees (2° to 12°) to a plane containing said throttle valve axis and extending generally perpendicularly to the flow through said induction passage for preventing flow between the periphery of said throttle valve and said induction passage when said throttle valve is in such closed position, and means for providing a bypass air flow directly through said induction passage and past said throttle valve for at least engine idle air flow when said throttle valve is in said closed position.

2. A throttle valve arrangement as defined in claim 1, wherein the idle air flow is provided by an opening in the throttle valve.

3. A throttle valve arrangement as defined in claim 1, wherein the opening comprises a circular opening that has its effective area decrease as the throttle valve is pivoted from the idle position to the open position.

4. A throttle valve arrangements as defined in claim 1, wherein the angle range is 5 to 11 degrees (5°–11°).

5. A throttle valve arrangement as defined in claim 4, wherein the angle of the throttle valve in its closed position is at ten degrees (10°).

6. A throttle valve arrangement as defined in claim 5, wherein the idle air flow is provided by an opening in the throttle valve.

7. A throttle valve arrangement as defined in claim 6, wherein the opening comprises a circular opening that has its effective area decrease as the throttle valve is pivoted from the idle position to the open position.

* * * * *

UNITED STATES PATENT AND TRADEMARK OFFICE

CERTIFICATE OF CORRECTION

PATENT NO. : 6,142,118
DATED : November 7, 2000
INVENTOR(S) : Hitoshi Motose

It is certified that error appears in the above-identified patent and that said Letters Patent is hereby corrected as shown below:

Title page,
Item [30], delete Foreign Application Priority Data
"May 10, 1994 [JP]…….. 6-119723"

Signed and Sealed this

Sixteenth Day of September, 2003

JAMES E. ROGAN
*Director of the United States Patent and Trademark Office*